US010604721B2

(12) United States Patent
Litters et al.

(10) Patent No.: US 10,604,721 B2
(45) Date of Patent: Mar. 31, 2020

(54) PROCESS FOR THE PREPARATION OF POLYUREA-THICKENED LIGNIN DERIVATIVE-BASED LUBRICATING GREASES, SUCH LUBRICANT GREASES AND USE THEREOF

(71) Applicant: FUCHS PETROLUB SE, Mannheim (DE)

(72) Inventors: Thomas Litters, Hettenleidelheim (DE); Florian Hahn, Chicago, IL (US); Torsten Goerz, Hochspeyer (DE); Hans Jürgen Erkel, Bruchmühlbach-Miesau (DE)

(73) Assignee: FUCHS PETROLUB SE, Mannheim (DE)

( * ) Notice: Subject to any disclaimer, the term of this patent is extended or adjusted under 35 U.S.C. 154(b) by 0 days.

(21) Appl. No.: 15/556,602

(22) PCT Filed: Mar. 9, 2016

(86) PCT No.: PCT/DE2016/000100
§ 371 (c)(1),
(2) Date: Sep. 7, 2017

(87) PCT Pub. No.: WO2016/141911
PCT Pub. Date: Sep. 15, 2016

(65) Prior Publication Data

US 2018/0258368 A1 Sep. 13, 2018

(30) Foreign Application Priority Data

Mar. 9, 2015 (DE) ..... 10 2015 103 440

(51) Int. Cl.

| | |
|---|---|
| ***C10M 169/06*** | (2006.01) |
| ***C10M 169/02*** | (2006.01) |
| ***C10M 119/24*** | (2006.01) |
| ***C10M 115/08*** | (2006.01) |
| ***C10M 151/04*** | (2006.01) |

(52) U.S. Cl.
CPC ..... *C10M 169/06* (2013.01); *C10M 115/08* (2013.01); *C10M 119/24* (2013.01); *C10M 151/04* (2013.01); *C10M 169/02* (2013.01); *C10M 2201/041* (2013.01); *C10M 2203/1006* (2013.01); *C10M 2203/1025* (2013.01); *C10M 2209/12* (2013.01); *C10M 2215/1023* (2013.01); *C10M 2215/1026* (2013.01); *C10M 2221/041* (2013.01); *C10N 2210/01* (2013.01); *C10N 2210/02* (2013.01); *C10N 2220/022* (2013.01); *C10N 2230/02* (2013.01); *C10N 2230/06* (2013.01); *C10N 2230/08* (2013.01); *C10N 2230/10* (2013.01); *C10N 2240/02* (2013.01); *C10N 2240/04* (2013.01); *C10N 2250/10* (2013.01); *C10N 2270/00* (2013.01)

(58) Field of Classification Search
CPC ..... C10M 169/06; C10M 151/04; C10M 115/08; C10M 2215/1026; C10M 2221/041; C10M 2203/1006; C10M 2201/041; C10N 2240/02; C10N 2230/10; C10N 2230/06; C10N 2230/02; C10N 2250/10; C10N 2240/04; C10N 2270/00; C10N 2220/022
See application file for complete search history.

(56) References Cited

U.S. PATENT DOCUMENTS

| | | | | |
|---|---|---|---|---|
| 3,249,537 | A | 5/1966 | Morway et al. | |
| 6,172,013 | B1 | 1/2001 | Holt et al. | |
| 2010/0234112 | A1* | 9/2010 | Kohana | C10M 111/04 464/7 |
| 2011/0190177 | A1* | 8/2011 | Zaki | C10M 135/10 508/148 |
| 2013/0338049 | A1 | 12/2013 | King et al. | |

FOREIGN PATENT DOCUMENTS

| | | | |
|---|---|---|---|
| CN | 102585970 | A * | 7/2012 |
| DE | 2121078 | A * | 7/1974 |
| DE | 3508718 | A | 9/1985 |
| DE | 10016845 | A1 | 5/2001 |
| DE | 102007048091 | | 6/2008 |
| DE | 102011108575 | A1 | 1/2013 |
| EP | 0435745 | A1 | 7/1991 |
| EP | 0508115 | A1 | 10/1992 |
| EP | 0558099 | A1 | 9/1993 |
| EP | 0661378 | A1 | 7/1995 |
| JP | 2014189763 | A | 10/2014 |
| WO | 8505421 | A1 | 12/1985 |

(Continued)

OTHER PUBLICATIONS

G. E. Fredheim, S. M. Braaten and B.E. Christensen, "Comparison of molecular weight and molecular weight distribution of softwood and hardwood lignosulfonates" published in the Journal of Wood Chemistry and Technology, vol. 23, No. 2, pp. 197-215, 2003.
Molecular weight determination of lignosulfonates by size exclusion chromatography and multi-angle laser scattering by the same authors as above, published in the Journal of Chromatography A, vol. 942, Edition 1-2, Jan. 4, 2002, pp. 191-199.
Cecilia F. Toledo et al: "Calcium Lignosulfate" Apr. 19, 2011 Retrieved from the Internet: URL:http://www.fao.org/fileadmin/templates/agns/pdf/jecfa/cta/69/Calcium_Lignosulfonate_40_65.pdf [retrieved on Jun. 2, 2016] p. I, paragraph 1.
International Search Report dated Jun. 23, 2016 for parent PCT application No. PCT/DE2016/000100.

*Primary Examiner* — Taiwo Oladapo
(74) *Attorney, Agent, or Firm* — D'Ambrosio & Menon, PLLC; Usha Menon

(57) ABSTRACT

The invention relates to a method for preparing lignin derivative-based lubricating greases thickened by a polyurea thickener, lubricating greases thus prepared, and the use of such lubricant greases, inter alia, in transmissions, constant-velocity driveshafts and sealed roller bearings.

22 Claims, No Drawings

(56) References Cited

FOREIGN PATENT DOCUMENTS

| | | | |
|---|---|---|---|
| WO | 2011095155 | A1 | 8/2011 |
| WO | 2014046202 | A1 | 8/2016 |

* cited by examiner

PROCESS FOR THE PREPARATION OF POLYUREA-THICKENED LIGNIN DERIVATIVE-BASED LUBRICATING GREASES, SUCH LUBRICANT GREASES AND USE THEREOF

PRIORITY CLAIM

This patent application is the U.S National stage under U.S.C. 371 of PCT/DE2016/000100 filed Mar. 9, 2016 and designating the United States and claims priority to German Patent Application No.: DE 10 2015 103 440.9 filed Mar. 9, 2015.

FIELD OF INVENTION

Introduction

The invention relates to a method for preparing lignin derivative-based lubricating greases thickened by a polyurea thickener, lubricating greases thus prepared, and the use of such lubricant greases, inter alia, in transmissions, constant-velocity driveshafts and sealed roller bearings.

Prior Art and Problems of Prior Art

The use of lignin derivatives to produce lubricant greases is known.

U.S. Pat. No. 3,249,537 describes sodium lignosulphonate as a lubricating grease thickener in the presence of acetic acid, sodium hydroxide and/or lithium hydroxide, a longer-chain fatty acid, a base oil and an aminic additive. The lubricating grease receiving this composition is water-soluble and/or insufficiently resistant to water for many applications. When lubricating applications encapsulated with gaiters made of thermoplastic elastomer (TPE), for example constant-velocity driveshafts, such lubricating greases exhibit insufficient compatibility with the gaiters. Here, the encapsulating material frequently participates in the movements of the parts moving against one another or at least picks up vibrations. For this, mobility and in most cases too elasticity of the material are necessary, which cannot be adversely affected by contact and/or interaction with the lubricating grease.

Calcium lignosulfonates are also known from US 2011/0190177 A1 and WO 2011/095155 A1 as a component of lubricating greases. The latter concerns a complex fat and the use of constant-velocity driveshafts encapsulated by thermoplastic elastomer gaiters among other things. The former discloses the use of various thickening agents for calcium lignosulfonates, also including polyureas among other things.

WO 2014046202 A1 describes a lubricating grease containing 1-20 weight percent of liqnophenol derivatives, for example of the structure:

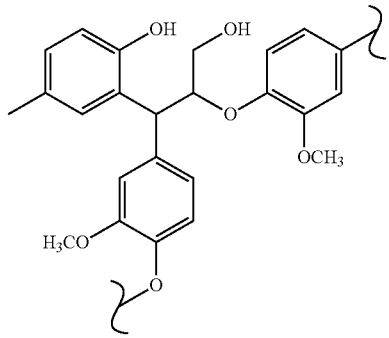

in the base oil. Polyurethanes or polyurea thickeners are not mentioned.

US 201310338049A1 discloses a lubricant grease composition containing lignin derivatives and various thickening agents; these also include polyurea thickeners in a mixture of base oils and additives. The lignin derivatives are added to a ready-made polyurea lubricating grease.

It was now found that stirring in lignin derivatives to a polyurea lubricating grease which has already been prepared can be problematic for particular applications for the following reason. The conversion of isocyanates with amines which is necessary to produce a polyurea thickener frequently has the disadvantage of subsequent cross-linking reactions if the isocyanate is not completely converted and is added in excess to the amines. Moreover, unconverted amine as well as isocyanate can lead to allergic reactions such as skin irritations and intolerance of materials such as plastics or elastomers which react to subsequent cross-linking due to amines or isocyanates. Furthermore, lignin derivatives have considerable quantities of water—4 to 8 weight percent in lignosulfonates, for example. This can result in insufficient thermal stability of the lubricant greases containing lignin derivatives at higher application temperatures due to the volatilization of water and other volatile or easily degraded components. In sealed or encapsulated lubricating points this leads to overpressure build-up, which can lead to damage of the seal or encapsulation or respectively to escaping grease or infiltration of water and contamination.

Furthermore, it was observed that subsequently stirring in lignin derivatives to a ready-made polyurea lubricating grease results in decreased thickening efficiency of the polyurea thickener or respectively to a proportion of thickener about 10% to 25% higher be necessary to establish a prespecified consistency of the lubricating grease than would be used in comparable lubricating greases with comparable consistency in which the lignin derivative was introduced according to the inventive method. The greater proportion of thickener increases the shear viscosity of a lubricating grease, particularly at low temperatures, with consequent decreased ability to deliver it in greasing and central lubrication systems.

Polyurea greases for constant-velocity driveshafts are described in numerous patents, including EP0435745 A1, EP0508115 A1, EP0558099 A1 and EP0661378 A1.

In present-day polyurea and polyurethane greases, tribochemically active EP/AW additives used assume a significant share of formulation costs and are thus often the price-increasing factor for lubricating greases. Many of these additives are produced in complex, multi-stage synthesis procedures, and their use is limited by their toxicological side effects in many cases as well as by the type of application and their applied concentration in the final formulation. In some applications, for example in constant-velocity driveshafts or slow-running roller bearings subject to high stress, insufficient lubrication conditions or respectively contact of the friction partner by liquid lubricants can also not be avoided through liquid additives. In these cases in practical use up to now, solid lubricants based on inorganic compounds (such as boron nitride, carbonates, phosphates, or hydrogen phosphates), powdered plastic (such as PTFE) or metal sulfides (such as $MoS_2$) were used. These components are also often expensive and decisively influence the total costs of a lubricant formulation.

Furthermore, the lubricant greases should be thermally inert and the lignin derivatives in them homogeneous as solids, distributed with small particle sizes.

Object of the Invention

The object of the present invention includes overcoming the disadvantages of prior art described above, such as:

- minimizing post-cure, for example in the presence of humidity;
- thermal stability, i.e. minimizing the overpressure build-up in sealed lubricant grease applications for example;
- increasing compatibility with seals and gaiters;
- improving the homogeneity of the grease and of the lignin derivative particle distribution;
- increasing the thickening efficiency of the polyurea thickener;
- reducing oil separation,
- optimizing the ability to deliver in greasing facilities and the suitability for low temperature;
- minimizing the post-cure of polyurea greases during storage and thermal stress;
- optimizing the material compatibility (plastics and elastomers) of polyurea greases; and
- effecting an improvement of the lubricating action of lignin derivatives in polyurea greases.

Invention Summary

This and additional objects are solved by the subject of the independent claims. Preferred embodiments are the subject of the dependent claims or are described below.

The subject of the invention is that the lignin derivative in the base oil is subjected to temperatures above 110° C., preferably above 120° C. and with particular preference above 170° C. or even above 180° C., particularly for more than 30 minutes. This can occur by (A) the lignin derivative in the base oil being heated separately as described above and added after formation of the polyurea thickener;

(B.1) the lignin derivative being added prior to formation of the polyurea thickener, i.e. before bringing together the amine component and the isocyanate component, so that amine components and isocyanate components and the polyurea thickener forming are heated together as described above, or (B.2) the lignin derivative being added after bringing together amine components and isocyanate components, i.e. at a time when the polyurea thickener has at least partially formed and is possibly already essentially completed but the temperature treatment of the polyurea thickener is not yet concluded, i.e. a temperature greater than 120° C. or greater than 110° C. was not yet achieved, so that the at least partially formed and possibly already essentially complete polyurethane thickener and lignin derivative are heated together as described above.

The variants B.1 and B.2 are preferred, and B.2 is particularly preferred. The special advantage of the variants B.1 and B.2 is that when working with an initial isocyanate access, first of all, a complete conversion of amine can be achieved due to the multi-stage nature of the process, and after that the abreaction of excess isoyanate groups is also possible in a time-delayed manner at increased temperature and in the presence of the lignin derivative.

It is now found that, in contrast to conventional lignin derivative-containing greases based on soap or polyurea thickeners, the inventive lubricating greases exhibit unexpectedly good characteristics for use as lubricating grease in plain bearings and roller bearings, transmissions and universal joints and can be applied well using greasing facilities and central lubrication systems. The inventive lubricating greases clearly differentiate themselves from conventional greases.

The inventive lubricating greases are distinguished by a particular thermal resistance, described by an evaporation loss according to DIN 58397-1 of less than 8% after 48 hours at 150° C. The inventive lubricating greases are further distinguished by a proportion of water below 100 ppm with reference to the quantity of lignin derivative added, determined according to DIN 51777-1.

Due to an improved dewatering of the greases to a very low level of residual moisture, under tribological stress with high loads and pressures which can cause high frictional heat and thus a friction energy input, cavitation damage of lubricated material surfaces is minimized in sliding or rolling pairs. This promotes low wear and high service life of components lubricated with inventive lubricating greases.

The inventive lubricating greases also exhibit particularly fine, homogeneous particle distribution, even if these were not treated with typical homogenization methods for industrial manufacturing processes such as toothed colloid mills or high-pressure homogenizers. If no step involving heating of the lignin derivative to above 120° C. occurs, larger particles form on average. The size of the particles can be determined, for example, with a grindometer as per Hegman ISO 1524.

The inventive lubricating greases are distinguished by improved low temperature behavior, described by a flow pressure according to DIN 51805 at −40° C. which is up to 25% lower than with comparable lubricating greases with which the lignosulfonate was not heated together in the presence of polyurea thickener or excess isocyanate.

The inventive lubricants are distinguished by improved ability to be delivered and ability to pass through filters. Both are important criteria for applications of lubricating greases in greasing facilities or respectively central lubrication systems. The ability to deliver can be described by the shear viscosity (flow resistance) in accordance with DIN 51810-1. It was observed that this is about 10% lower at the same test temperature then with comparable lubricating greases of comparable consistency in which the lignosulfonate was not heated together in the presence of the polyurea thickener or excess isocyanate to temperatures greater than 110° C.

It was observed that with the use of the same lignin derivatives, the maximum particle size is generally more than 30% smaller as a result of the heating step above 110° C., particularly above 120° C., when tested with a grindometer according to Hegman ISO 1524.

DETAILED DESCRIPTION OF THE INVENTION

According to the embodiment (A), the lignin derivative was only added later together with the base oil, specifically when the polyurea thickener in the base oil is already prepared and the lignin derivative is subsequently added together with base oil, with the lignin derivative previously having been heated in the base oil to a temperature above 110° C., preferably above 120° C. and with particular preference above 170° C. or even above 180° C., particularly for 30 minutes and longer.

It is particularly preferred that the addition takes place if the lubricating grease composition is coming from the polyurea thickener production where generally heating occurs at temperatures above 120° C., particularly 170° C., with cooling to temperatures below 80° C., and the addition of the treated lignin derivative occurs together with the addition of the other additives.

The subject of the invention is furthermore a method in which according to the embodiment (B) or respectively (B.1) and (B.2) the lignin derivative and polyurea thickener or respectively its reactants—amine and isocyanate—are subjected together in the base oil to temperatures above 110° C., preferably above 120° C. and with particular preference above 170° C. or even above 180° C., particularly for 30 minutes and longer.

According to the particularly preferred embodiment (B.1) of the embodiment (B), the polyurea thickener is produced in the presence of the lignin derivative by a mixture of isocyanates and amines (plus possibly alcohols) being converted together in the presence of the lignin derivative and subsequently subjected by heating to temperatures above 110° C., preferably above 120° C. and with particular preference above 170° C. or even above 180° C., particularly for 30 minutes and longer.

According to a further embodiment B.2 of the embodiment (B) of the invention, the lignin derivative is added after the polyurea thickener is completely or partially produced from the isocyanate and amine component (also possibly containing alcohols). This ensures first of all the most complete conversion of the amines (and perhaps alcohols) possible to form the polyurea thickener and then heating to a temperature above 120° C., with particular preference above 170° C. or even above 180° C., particularly for 30 minutes and longer.

Here it is possible according to a preferred form of the embodiments (B.1) and (B.2) that the isocyanate component is used with a stoichiometric excess of isocyanate groups versus the reactive amine groups (at below 110° C., in particular below 120° C., including possible hydroxyl groups of the amine component which are reactive (at below 110° C., in particular below 120° C.)), preferably with the use of an isocyanate excess of up to 10 mole percent, preferably from 0.1 to 10 mole percent or 5 to 10 mole percent. In particular the isocyanate excess is greater than 0.1%, preferably greater than 0.5%.

This should effect or promote conversion with the lignin derivative by subsequent heating, particularly a conversion with the hydroxyl groups or other functional groups of the lignin derivative which are reactive with isocyanate. The isocyanates are completely converted with the amines, alcohols, reactive components of the lignin derivatives and perhaps with some excess water by the heating. This prevents or reduces subsequent curing of the lubricating greases during use after production. Surprisingly, it was found with the heating procedure for the lignin derivative in the presence of the polyurea thickener that lignin derivative is subsequently present in a more homogeneous distribution.

According to a preferred form of the embodiments (B.1), the isocyanate is added in molar excess with respect to the material quantity of the amines or alcohols used to form the polyurea grease, so that first of all the complete conversion of the amines and alcohols is insured and subsequently residual isocyanate reacts with the reactive groups of the lignin derivative. Thus an additional thickening effect and good aging stability are achieved for the lubricating greases.

Furthermore, it was observed that by converting the lignin derivatives with excess isocyanate groups better solubility of the lignin derivative in the base oil is also achieved along with a better thickening effect. This improves the additive effect of the lignin derivative.

As evidence that diisocyanates are suitable for reacting with lignin derivatives, MDI was heated together with lignosulfonate in the absence of other reactive compounds such as amines or alcohols, and a thickening was observed. This documents that the diisocyanates are able to cross-link lignin derivatives. With this, the reaction product from isocyanate and lignin derivative acts as an additional thickener for the lubricating grease along with the polyurea thickener.

As proof that lignin derivatives are not sufficiently dewatered at temperatures below 110° C., a drying test was conducted in the desiccator under vacuum and over a drying agent at 60° C. for three days.

Here was determined for two different lignin derivatives (the calcium lignosulfonate Norlig 11 D from Borregard Lignotech and Desilube AEP from Desilube Technology) that these could not be sufficiently dewatered, because they still showed water concentrations of 60,000 ppm or respectively 18,000 ppm afterward which at an applied concentration of 10% lignin derivative in a lubricating grease would have given a water content of 6000 ppm and 1800 ppm respectively.

The conversion to the base grease takes place in the base oil in a heated reactor which can also be implemented as an autoclave. Afterward in a second step, the formation of the thickener structure is completed by cooling, and possibly other components such as additives and/or additional base oil are added to achieve the desired consistency or profile of properties. The second step can be carried out in the reactor for the first step, but preferably the base grease is transferred from the reactor to one or more separate stirring vessels for cooling and mixing of possible additional components.

If necessary, the lubricating grease thus obtained is homogenized and/or filtered and/or de-aired.

It is also suspected that the lignin derivatives themselves cross-link with the functional groups found in the lignin derivative as a result of the heating procedure and volatile components such as groups containing hydroxyl functionality or $CO_2$, etc. escape. This would explain the experimentally observed difference between evaporation loss and water elimination, because the reduction of the evaporation loss is greater than the amount of dewatering this would cause one to expect even if there is no excess of isocyanate.

Lignin is a complex polymer based on phenylpropane units which are linked to each other with a range of various chemical bonds. Lignin occurs in the cells of plants together with cellulose and hemicellulose. Lignin itself is a cross-linked macromolecule. Essentially, three types of monolignol monomers can be identified as monomer building blocks of the lignin; these are differentiated from one another by the degree of methoxylation. These are p-coumaryl alcohol, and. These lignols are incorporated in the lignin structure as hydroxyphenyl (H), guaiacyl (G), and syringyl (S) units. Gymnosperms such as pines predominantly contain G units and low portions of H units.

All lignins contain small portions of incomplete or modified monolignols. The primary function of lignins in plants is to provide mechanical stability by cross-linking polysaccharides in the plants.

Lignin derivatives are degradation products or conversion products of lignin in the sense of the present invention, which make the lignin accessible in isolation or respectively split off and to this extent are typical products such as those which are produced during the production of paper.

With the lignin derivatives to be used in accordance with the invention, a further distinction can be made between lignin obtained from softwood and those from hardwood. In the sense of the present invention, lignin derivatives obtainable from softwood are preferred. These have higher molecular weight and with driveshafts tend to provide lubricating greases with better service life.

For the extraction or chemical digestion of lignins from lignocellulose biomass, a distinction is made between processes with sulfur and those without sulfur. In the processes with sulfur, a distinction is made between the sulfite method and the sulfate method (kraft method) with which the lignin derivatives are recovered from hardwood or softwood.

In the sulfite method, the lignosulfonate occurs as a side product in the production of paper. In the process, wood which is reduced to chips is heated for about 7 to 15 hours under pressure (5 to 7 bar) in the presence of calcium hydrogen sulfite base and then the lignosulfonic acid is removed from the lignocellulose in the form of calcium lignosulphonate via a washing and precipitation process. Instead of calcium hydrogen sulfite, magnesium, sodium or ammonium sulfite bases can also be used, which leads to the corresponding magnesium, sodium and ammonium salts of lignosulfonic acid. By evaporating the washing liquor, one obtains the powdered lignosulfonates available commercially and used in the sense of the present invention.

Among the lignosulfonates according to the sulfite method, calcium and/or sodium lignosulfonate or their mixtures are used preferably. Particularly suited as a lignosulphonate are lignosulfonates with a molecular weight (Mw, weight average) preferably greater than 10,000, particularly greater than 12,000 or even greater than 15,000 g/mole, preferably used for example from greater than 10,000 to 65,000 g/mole or 15,000 to 65,000 g/mole, which particularly contain 2 to 12 weight percent, particularly 4 to 10 weight percent sulfur (calculated as elemental sulfur) and/or 5 to 15 weight percent, particularly 8 to 15 weight percent calcium (calculated Ca).

Along with calcium lignosulfonates, other alkali or alkaline earth lignosulfonates can be used or their mixtures also be used.

Suitable calcium lignosulfonates are, for example, the commercially available products Norlig 11 D and Borrement Ca 120 from Borregard Ligno Tech or Starlig CP from Ligno Star. Suitable sodium lignosulfonates are Borrement NA 220 from Borregard Ligno Tech or Starlig N95P from Ligno Star.

With the sulfate or kraft method, wood chips or chopped plant stems are seated in pressure vessels for three to six hours at higher pressure (7 to 10 bar), essentially with sodium hydroxide, sodium sulfide and sodium sulfate. In this process, the lignin is cleaved by nucleophilic attack of the sulfide anion and forms a so-called black liquor (soluble alkali lignin), which then is separated from the remaining pulp using cellular filters. Suitable kraft lignins are, for example, Indulin AT from MWV Specialty Chemicals or Diwatex 30 FK, Diwatex 40 or Lignosol SD-60 from Borregard Ligno Tech (USA). The kraft method is currently used in about 90% of pulp production worldwide. Kraft lignins are frequently derivatized further by sulfonation and amination.

The LignoBoost process is a subvariant of the kraft method. In this process, the sulfate lignin is precipitated from a concentrated black liquor by reducing the pH or stepwise introduction of carbon dioxide and addition of sulfuric acid (P. Tomani & P. Axegard, ILI 8th Formu Rome 2007).

With the sulfur-free method, a distinction is made, for example, between the organosolv method (solvent pulping) and the soda method (soda pulping).

In the organosolv method, lignins and lignin derivatives are extracted from hardwood and softwood. The most frequent organosolv method commercially used is based on digestion of the lignins with a mixture of alcohol (ethanol) and water or with acetic acid mixed with other mineral acids. Methods with phenol digestion and monoethanolamine digestion are also known.

Organosolv lignins are frequently highly pure and insoluble in water and easily soluble in organic solvents and can thus be used even better as lignosulfonates or kraft lignins in lubricant formulations.

Suitable organosolv lignins (CAS no. 8068-03-9) can be obtained from Sigma Aldrich, for example.

With the soda method, so-called soda lignins are obtained, particularly from annuals such as residual materials like cane trash or straw, by digestion with sodium hydroxide. They are soluble in aqueous alkaline media.

One lignin derivative suited as a lubricant component continues to be Desilube AEP (pH 3.4, with acid groups based on sulfur) from Desilube Technology, Inc.

In contrast to lignosulfonates and kraft lignins, neither soda nor organosolv lignins have sulfonate groups, and they have a lower ash content. They are thus better suited for chemical conversion with lubricant thickening components such as isocyanate. A particular aspect with organosolv lignins is that these have many phenolic hydroxyl groups together with low ash content and the absence of sulfonate groups and are thus easier to convert with isocyanates than the other lignin derivatives.

In the particular case of lignin derivatives with an acid pH, due to incompletely neutralized carbonic or sulfonic acid groups it is assumed that in the synthesis of the polyurea thickener too, amines and possibly alcohols added in excess can lead to amidation and esterification reactions. The amide, sulfonamide, ester or sulfonic acid ester groups resulting from this can also lead to an additional thickening effect, improved aging stability and improved compatibility with elastomers sensitive to hydrolysis, such as materials for gaiters based on thermoplastic polyether esters. Furthermore, adding additional alkali or alkaline earth hydroxides such as calcium hydroxide, for example, can also serve to neutralize the acid groups of the lignin derivatives and thus ensure an additional thickening effect and improved aging stability as well as elastomer compatibility.

If the lignin derivative is acidic, $Ca(OH)_2$, NaOH or amines can also be added to the lubricating grease.

Lignin derivatives are effective components in lubricating greases and are used today for improving the wear protection characteristics and extreme pressure failure load properties. Here the lignin derivatives can represent multifunctional components. Due to their high number of polar groups and aromatic structures, there polymeric structure and the low solubility in all types of lubricating oils, powdered lignins and/or lignosulfonates are also suited as solid lubricants in lubricating greases and lubricating pastes. Furthermore, the phenolic hydroxyl groups contained in lignin and lignin sulfonates provide an effect which inhibits aging. In the case of lignosulfonates, the sulfur portion in lignosulfonates promotes the EP/AW effect in lubricating greases.

The average molecular weight is determined, for example, by size exclusion chromatography. A suitable method is the SEC-MALLS as described in the article by G. E. Fredheim, S. M. Braaten and B. E. Christensen, "Comparison of molecular weight and molecular weight distribution of softwood and hardwood lignosulfonates" published in the Journal of Wood Chemistry and Technology, Vol. 23, No. 2, pages 197-215, 2003 and the article "Molecular weight determination of lignosulfonates by size exclusion chromatography and multi-angle laser scattering" by the same authors, published in the Journal of Chromatography A, Volume 942, Edition 1-2, 4 Jan. 2002, pages 191-199 (mobile phase: phosphate-DMSO-SDS, stationary phase: Jordi Glucose DVB as described under 2.5).

The polyurea thickeners are composed of urea bonds and possibly polyurethane compounds. These can be obtained by converting an amine component with an isocyanate component. The corresponding greases are then referred to as polyurea greases.

The amine component has monoaminohydrocarbyl, di- or polyaminohydrocarbylene bonds possibly along with additional groups reactive to isocyanate, partitularly monohydroxycarbyl, di- or polyhydroxycarbylene or aminohydroxyhydrocarbylene. The hydrocarbyl or hydrocarbylene groups preferably each have 6 to 20 carbon atoms, with particular preference for 6 to 15 carbon atoms. The hydrocarbylene group preferably has aliphatic groups. Suitable representatives are named in EP 0508115 A1, for example.

The isocyanate component has mono- or polyisocyanates, with the polyisocyanates preferably being hydrocarbons with two or more isocyanate groups. The isocyanates have 5 to 20, preferably 6 to 15 carbon atoms and preferably contain aromatic groups.

The amine component is either di- or multifunctional or the isocyanate component or both.

Typically the polyurea thickeners are the reaction product of diisocyanates with C6 to C20 hydrocarbyl(mono)amines or a mixture with hydrocarbyl(mono)alcohols. The reaction products are obtained, for example, with reference to the ureas from the conversion of C6 to C20 hydrocarbylamines and a diisocyanate. This also applies correspondingly for alcohols used in addition or for mixed forms where compounds are used which have both amine and hydroxyl groups. The latter are also called polyurea-polyurethane greases, which are included in the term polyurea greases in the sense of the present invention.

However, reaction products of monoisocyanates and possibly including diisocyanates with diamines and possible additional alcohols can also be used.

The polyurea thickeners typically have no polymeric character, but instead are dimers, trimers or tetramers, for example.

Diureas are preferred which are based on 4,4'-diphenylmethane diisocyanate (MDI) or m-toluene diisocyanate (TDI) and aliphatic, aromatic and cyclic amines or tetraureas based on MDI or TDI and aliphatic, aromatic and cyclic mono- and diamines.

In addition to the polyisocyanates, components of the type R—NCO (monoisocyanates) can also be used, where R represents a hydrocarbon moiety with 5 to 20 carbon atoms.

The monoisocyanates are preferably added together with the lignin derivative during the production of lubricating grease if the formation of the thickener according to the polyurea or polyurea/polyurethane components is completed in order to react with functional groups of the lignin derivative to form additional thickening components. Alternatively, in addition of R—NCO and lignin and/or lignin sulfonate is also possible prior to the addition of the polyurea or polyurea/polyurethane components.

Optionally, bentonites such as montmorillonite (whose sodium ions are possibly exchanged in whole or in part by organically modified ammonium ions), aluminosilicates, clays, hydrophobic and hydrophilic silicic acid, oil-soluble polymers (such as polyolefins, polymethylmethacrylates, polyisobutylenes, polybutylenes or polystyrene copolymers) can also be used as co-thickeners. The bentonites, aluminosilicates, clays, silicic acid and/or oil-soluble polymers can be added to produce the base grease or later as an additive in the second step. Simple, mixed or complex soaps based on lithium, sodium, magnesium, calcium, aluminum and titanium salts of carboxylic acids or sulfonic acids can be added during the production of the base grease or later as an additive. Alternatively, these soaps can also be formed in situ during production of the greases.

The inventive compositions possibly contain further additives as admixtures. Usual additives in the sense of the invention are antioxidants, wear protection agents, anticorrosion agents, detergents, pigments, lubrication promoters, adhesion promoters, viscosity additives, antifriction agents, high pressure additives and metal deactivators.

The practice up to now in the production of lubricating grease is to add lignin derivatives in a second process step at low temperatures after the actual chemical reaction process for forming the thickener. However, this step has the disadvantage that the lignin derivatives must be distributed homogeneously in the lubricating grease by intensive mixing and shear processes with greater mechanical effort in order to achieve their optimal effect. For industrial production, there are frequently no suitable machines available for such mixing and shear processes and techniques from laboratory practice such as a three roll mill cannot be scaled up for industrial production.

Many lubricating greases are applied by automated greasing facilities particularly during the industrial manufacture of plain bearings and roller bearings and driveshafts in large quantities. In practice here, problems with metering occur time and again in greasing facilities if poorly distributed lignin derivative particles in the lubricant grease clog filters, pipes with small diameters or metering nozzles. In the worst case, this can lead to production downtime with corresponding consequential costs. The same problem can occur in central lubrication systems for loss lubrication of machines and vehicles used, for example, in coal mining, the steel industry or agriculture. Therefore it is favorable for the distribution and effect of lignin derivatives if these are already incorporated chemically or mechanically in the thickener structure during or directly after the reaction phase as an additional structure element in situ. The finer the distribution of the lignin derivative particles in the lubricating grease, the smaller the filter mesh sizes the user can apply in greasing or central lubrication facilities to protect a lubricating grease for protection against the entry of foreign materials (such as dust or metal particles) into the lubrication point.

Examples to name are:

Primary antioxidants such as amine compounds (such as alkyl amines or 1-phenylaminonaphthalene), aromatic amines such as phenylnaphthylamines or diphenylamines or polymeric hydroxyquinolines (such as TMQ), phenol compounds (such as 2,6-di-tert-butyl-4-methylphenol), zinc dithiocarbamate or zinc dithiophosphate.

Secondary antioxidants such as phosphites, for example tris(2,4-di-tert-butylphenyl phosphite) or bis(2,4-di-tert-butylphenyl)-pentaerythritol diphosphite.

High pressure additives such as organochlorine compounds, sulfur or organic sulfur compounds, phosphorus compounds, inorganic or organic boron compounds, zinc dithiophosphate and organic bismuth compounds.

Active substances which improve "oiliness" such as C2 to C6 polyols, fatty acids, fatty acid esters or animal or vegetable oils;

Anticorrosion agents such as petroleum sulfonate, dinonylnaphthalene sulfonate, or sorbitan esters; disodium decandioate, neutral or overbased calcium sulfonates, magnesium sulfonates, sodium sulfonates, calcium and sodium naphthalene sulfonates, calcium salicylates, aminophosphates, succinates, and metal deactivators such as benzotriazole or sodium nitrite;

Viscosity promoters such as polymethacrylate, polyisobutylene, oligo-dec-1-ene, polystyrenes;

Wear-protection additives and antifriction agents such as organomolybdenum complexes (OMCs), molybdenum dialkyldithiophosphates, molybdenum dialkyldithiocarbamates or molybdenum dialkyldithiocarbamates, in particular molybdenum di-n-butyldithiocarbamate and molybdenum dialkyldithiocarbamates ($Mo_{2m}S_n$(dialkylcarbamate)2 with m=0 to 3 and n=4 to 1), zinc dithiocarbamate or zinc dithiophosphate;

or a three-atom molybdenum compound corresponding to the formula $$Mo_3S_kL_nQ_z,$$

in which L represents independently selected ligands which have organic groups with carbon atoms as disclosed in U.S. Pat. No. 6,172,013 B1 in order to make the compound soluble or dispersible in oil, with n ranging from 1 to 4, k from 4 to 7, Q is selected from the group of neutral electron donating compounds comprised of amines, alcohols, phosphines and ethers, and z is in the range from 0 to 5, including non-stoichiometric values (compare DE 102007048091);

Antifriction agents such as functional polymers like oleylamides, organic compounds based on polyethers and amides such as alkylpolyethyleneglycol tetradecyleneglycol ether, PIBSI or PIBSA.

Furthermore, the inventive lubricant grease compositions contain usual additives to protect against corrosion, oxidation and the influence of metals which act as chelating compounds, radical traps, UV converters, formers of reaction layers and suchlike. Additives which improve the resistance of ester base oils to hydrolysis, such as carbodiimides or epoxide, can also be used.

Solid lubricants which can be used include polymer powders such as polyamides, polyimides or PTFE, melamine cyanurate, graphite, metal oxides, boron nitride, silicates such as magnesium silicate hydrate (talc), sodium tetraborate, potassium tetraborate, metal sulfides such as molybdenum disulfide, tungsten disulfide or mixed sulfides based on tungsten, molybdenum, bismuth, tin and zinc, inorganic salts of alkali and alkaline earth metals such as calcium carbonate. sodium and calcium phosphates. The same applies to carbon black or other carbon-based solid lubricants, such as nanotubes for example.

The desired advantageous lubrication properties can be established by the use of lignin derivatives without having to use solid lubricants. In many cases, these can be omitted entirely but they can at least be significantly minimized. To the extent that solid lubricants are used, graphite can be used advantageously.

Lubricating oils which are usually liquid at room temperature are suitable as base oils. The base oil has a kinematic viscosity of 20 to 2500 $mm^2/s$, in particular of 40 to 500 $mm^2/s$ at 40° C. The base oils can be classified as mineral oils or synthetic oils. Mineral oils to consider are, for example, naphthenic and paraffinic mineral oils according to classification as API Group I. Chemically modified mineral oils which are low in aromatics and sulfur and which have a small proportion of saturated compounds and exhibit improved viscosity/temperature behavior versus Group I oils are also suitable.

Synthetic oils worth mention are polyethers, esters, polyesters, polyalphaolefins, polyethers, perfluoropolyalkyl ethers (PFPAEs), alkylated naphthalenes, and alkyl aromatics and their mixtures. The polyether compound can have free hydroxyl groups but can also be completely etherified or the end groups be esterified and/or can be made from a starting compound with one or more hydroxy and/or carboxy) groups (—COOH). Polyphenyl ethers are also possible, perhaps alkylated, as sole components or even better as components in a mixture. Esters of an aromatic di-, tri- or tetracarboxylic acid are also suited for use with one or more C2 to C22 alcohols present in the mixture, esters of adipic acid, sebacic acid, trimethylolpropane, neopentyl glycol, pentaerythritol or dipentaerythritol with aliphatic branched or unbranched, saturated or unsaturated C2 to C22 carboxylic acids, C18 dimer acid esters with C2 to C22 alcohols and complex esters as individual components or in any mixture.

The lubricant grease compositions are preferably comprised as follows:

55 to 92 weight percent, in particular 70 to 85 weight percent of the base oil;

0 to 40 weight percent, in particular 2 to 10 weight percent of additives;

3 to 40 weight percent, in particular 5 to 20 weight percent of polyurea thickener;

0.5 to 50 weight percent, in particular 2 to 15 weight percent of lignin derivative, preferably calcium and/or sodium lignosulfonate or a kraft lignin or an organosolv lignin or their mixtures;

and from the following optional components:

0 to 20 weight percent of other thickeners, in particular soap thickeners or complex soap thickeners based on calcium, lithium or aluminum salts;

0 to 20 weight percent, 0 to 5 weight percent of inorganic thickener such as bentonite or silica gel; and 0 to 10 weight percent, in particular 0.1 to 5 weight percent of solid lubricant, in particular an isocyanate excess is applied, particularly of 0.1 to 10 mole percent and with particular preference from 1 to 10 mole percent, in particular 5 to 10 mole percent (molar excess with respect to the reactive groups), with the excess of isocyanate groups calculated with respect to the reactive amine groups including possible reactive hydroxy groups of the amine component.

According to the method underlying the present invention, a precursor (base grease) is produced first of all by combining at least a base oil, an amine component and an isocyanate component and heating above 120° C., particularly above 170° C. or even 180° C. to produce the base grease, cooling the base grease and mixing in the additives, preferably at below 100° C. or even below 80° C., and adding the lignin derivative prior to or after heating, and if after heating preferably together with the additives.

To produce the base grease, heating preferably occurs to temperatures above 110° C., in particular above 120° C. or better above 170° C. The conversion to the base grease takes place in a heated reactor which can also be implemented as an autoclave or vacuum reactor.

Afterward in a second step, the formation of the thickener structure is completed by cooling, and possibly other components such as additives and/or base oil are added to achieve the desired consistency or profile of properties. The second step can be carried out in the reactor for the first step, but preferably, the base grease is transferred from the reactor to a separate stirring vessel for cooling and mixing of possible additional components.

If necessary, the lubricating grease thus obtained is homogenized, filtered and/or de-aired. It is also ensured by a high process temperature above 120° C., in particular above 170° C., that the residual moisture still in the lignosulfonate is volatilized completely out of the reaction medium.

The inventive lubricating greases are particularly suited for use in or for constant-velocity driveshafts, plain bearings, roller bearings and transmissions. A particular aspect of the present invention is to achieve cost-optimized lubricant grease formulations for lubrication points subject to high stress such as in universal joints in particular, these formulations having good compatibility with gaiters made, for example, from thermoplastic polyether esters (TPEs) and chloroprenes (CRs) and at the same time a high degree of efficiency, low wear and long service life.

The gaiter compatibility corresponds to the results presented in WO 2011/095155 A1.

The gaiter material, including encapsulating materials, which is in contact with the lubricant is, according to a further embodiment of the invention, a polyester, preferably a thermoplastic copolyester elastomer including hard segments with crystalline properties and a melting point above 100° C. and soft segments with a glass transition temperature below 20° C., preferably below 0° C. Polychloroprene rubber and thermoplastic polyester (TPE), and thermoplastic polyether ester (TEEE=thermoplastic ether ester elastomer) are particularly suitable. The latter are available on the market under the trade names Arnitel® from DSM, Hytrel® from DuPont and PIBI-Flex® from P-Group WO 85/05421 A1 describes such suitable polyether ester material for gaiters based on polyether esters. DE 35 08 718 A also refers to a bellows body as an injection molded part made of a thermoplastic polyester elastomer.

The hard segments are derived, for example, from at least one aliphatic diol or polyol and at least one aromatic di- or polycarboxylic acid, the soft segments with elastic properties, for example, from ether polymers such as polyalkylene oxide glycols or non-aromatic dicarboxylic acids and aliphatic diols. Such compounds are referred to as copolyether esters, for example.

Copolyether ester compositions are used, for example, in parts when the part produced from them is subject to frequent deformation or vibrations. Very well-known applications in this regard are gaiters and/or air spring bellows used to protect driveshafts and transmission shafts, joint posts and suspension units as well as gasket rings. In such applications, the material also frequently or continuously comes in contact with lubricants such as lubricating greases.

The technical procedure can be such that the gaiter is manufactured by injection blow molding, injection extrusion or extrusion blow molding, with the ring-shaped parts made of rubber possibly placed beforehand in the mold on the two future fixing points.

The resistance of the copolyether ester composition to the effects of oils and greases is one of the reasons for its wide use along with its easy processability in relatively complex geometries.

Furthermore, the omission of other additives as friction reducers and protecting agents against extreme pressure failure load and wear results in good compatibility with standard commercial universal shaft drive gaiter materials such as chloroprene rubber and thermoplastic polyether esters.

A further particular aspect of the invention is the use of lubricating greases in roller bearings, even those with high load bearing capacity and high operating temperatures. The requirements for these greases are described inter alia in DIN 51825 and ISO 12924. A method for testing the wear protection effect of lubricating greases in roller bearings is described by DIN 51819-2. Methods for testing the service life of lubricating greases at a selected application temperature are described, for example, in accordance with DIN 51806, DIN 51821-2, ASTM D3527, ASTM D3336, ASTM D4290 and IP 168 and by the ROF test method from SKF. Thus, for example, lubricating greases have a good service life at 150° C. if they pass the test according to DIN 51821-2 at 150° C. with a 50% failure probability for the test bearing of more than 100 hours at 150° C.

The invention is explained below with examples without being limited to these. The details of the examples and the characteristics of the lubricating greases are given below in Tables 1 to 5.

Production Examples

Example A, B and E

Invention Examples: Diurea Thickener—Lignin Derivative Present During Base Grease Heating:

One third of the planned quantity of base oil (for A: altogether 78.51 weight percent, for B: altogether 83.81 weight percent, for E: altogether 82.9 weight percent) was placed in a reactor equipped with heating, then 4,4'-diphenylmethane diisocyanate was added (for A: 6.45 weight percent, for B: 3.22 weight percent, for E: 3.45 weight percent) and heated to 60° C. with stirring. A further third of the planned quantity of base oil was placed in a separate stirring tank equipped with heating and amine added (for A: 4.76 weight percent of n-octylamine and 1.29 weight percent of p-toluidine, for B: 4.96 weight percent of stearylamine and 0.61 weight percent cyclohexyl amine, for E: 5.3 weight percent of stearylamine and 0.65 weight percent of cyclohexyl amine) and heated to 60° C. with stirring. Then the mixture of amine and base oil was added from the separate stirring tank to the reactor and the batch was heated to 140° C. with stirring. After that, the lignin derivative was stirred into the reactor (for A: 6.99 weight percent of calcium lignosulfonate, for B: 5.40 weight percent calcium lignosulfonate, for E: 5.70 weight percent sodium lignosulfonate). The batch was heated to 180° C. with stirring, and the volatile components were vaporized. The temperature of 180° C. was maintained for 30 minutes. Here IR spectroscopy was used to check for complete conversion of the isocyanate by observing the NCO band between 2250 and 2300 $cm^{-1}$. The batch was cooled afterward. The batch is diluted with additives at 80° C. in the cooling phase. After adjustment of the batch to the desired consistency by addition of the remaining quantity of base oil planned, the final product was homogenized.

Example A1

Invention Example: Diurea Thickener—Lignin Derivative Present During Base Grease Heating, Isocyanate Excess of 10 Mole Percent Half the planned quantity of base oil was placed in a reactor equipped with heating (altogether 78.4 weight percent), then 4,4'-diphenylmethane diisocyanate (6.63 weight percent) was added and heated to 60° C. with stirring. Another half of the planned quantity of base oil was placed in a separate stirring tank equipped with heating and amine was added (4.68 weight percent of n-octylamine and 1.29 weight percent of p-toluidine) and heated to 60° C. with stirring. Then the mixture of amine and base oil was added from the separate stirring tank to the reactor and the batch was heated to 110° C. with stirring. A check of the reaction mixture by IR spectroscopy showed a pronounced isocyanate band between 2250 and 2300 $cm^{-1}$ (resulting from unconverted excess isocyanate).

After that the lignin derivative (7.0 weight percent calcium lignosulfonate) was transferred to the reactor and stirred in. The batch was heated to 180° C. with stirring, and the volatile components were vaporized. The temperature of 180° C. was maintained for 30 minutes. IR spectroscopy was used during the heating phase and dwell time to monitor the reaction and can document that the excess of isocyanate was successively consumed by reaction and completely disappeared after the end of the dwell time at 180° C. The batch was cooled afterward. The batch was diluted with additives in the cooling phase at temperatures below 110° C. Then the end product was homogenized.

Example A2

Example for Comparison: Diurea Thickener—Lignin Derivative Added in the Cooling Phase, with Equimolar Isocyanate:

Half the planned quantity of base oil was placed in a reactor equipped with heating (altogether 79.0 weight percent), then 4,4'-diphenylmethane diisocyanate (6.03 weight percent) was added and heated to 60° C. with stirring. Another half of the planned quantity of base oil was placed in a separate stirring tank equipped with heating and amine was added (4.68 weight percent of n-octylamine and 1.29 weight percent of p-toluidine) and heated to 60° C. with stirring. Then the mixture of amine and base oil was added from the separate stirring tank to the reactor and the batch was heated to 110° C. with stirring. The IR spectrum showed that the isocyanate band between 2250 and 2300 $cm^{-1}$ disappeared completely at 110° C. The batch was heated to 180° C. with stirring. The temperature of 180° C. was maintained for 30 minutes. The batch was cooled afterward. The lignin derivative (7.0 weight percent calcium lignosulfonate) was added at 110° C. in the cooling phase. The remaining additives were also added at temperatures below 110° C. Then the end product was homogenized.

Compared to Example A1, Example A2 is somewhat softer (higher penetration value) but demonstrates inferior capacity to resist wear and load stress (vibrational fretting increase run, Table 5). The oil separation is also greater.

Production Example C

Invention Example: Tetraurea Thickener—Lignin Derivative Present During Base Grease Heating:

One third of the planned quantity of 75.65 weight percent base oil was placed in a reactor equipped with heating, 9.41 weight percent of 4,4'-diphenylmethane diisocyanate added and heated to 60° C. with stirring. Then 2.4 weight percent hexamethylene diamine was added and maintained for 10 minutes. A further third of the planned quantity of base oil was heated to 60° C. with stirring in a separate stirring tank equipped with heating and then 1.57 weight percent cyclohexylamine and 2.05 weight percent n-octylamine added. Then the mixture of amine and base oil was added from the separate stirring tank to the reactor at 60° C. with stirring. After 30 minutes of reaction time, the remaining base oil was added and heated to 140° C. with stirring. After that 6.92 weight percent calcium lignosulphonate was stirred in, the batch was heated to 180° C. and kept at this temperature for 30 minutes while the volatile components vaporized. Here IR spectroscopy was used to check for complete conversion of the isocyanate by observing the NCO band between 2250 and 2300 $cm^{-1}$. Additives were mixed into the batch at 80° C. in the cooling phase and subsequently homogenized Production Example D Invention Example: Diurethane/Urea Thickener—Lignin Derivative Present During Base Grease Heating:

Two thirds of the planned quantity of 80.72 weight percent base oil were placed in a reactor equipped with heating and 4.77 weight percent of 4,4'-diphenylmethane diisocyanate added and heated to 60° C. with stirring. Then 2.56 weight percent tetra-decanol was added, heated to 65° C. with stirring and maintained at that temperature for 20 minutes. Afterward, 1.24% cyclohexylamine and 1.61 weight percent n-octylamine were added to the batch. After 30 minutes of reaction time the batch was heated to 140° C. and 7.1 weight percent calcium lignosulfonate was added, heated to 180° C. and maintained at this temperature for 30 minutes while the volatile components vaporized, and complete conversion of the isocyanate was checked by IR spectroscopy, monitoring the NCO band between 2250 and 2300 $cm^{-1}$. After a dwell time of 30 minutes, the batch was cooled and the additives put in at 80° C. After adjustment of the batch to the desired consistency by addition of the remaining base oil, the final product was homogenized.

Production Example F

Invention Example: Diurea Thickener—Lignin Derivative Heated Separately in Oil and Added to the Base Grease Heating as an Additive:

One third of the planned quantity of 82.18 weight percent base oil was placed in a reactor equipped with heating, 3.64 weight percent of 4,4'-diphenylmethane diisocyanate added and heated to 60° C. with stirring. A further third of the planned quantity of base oil was placed in a separate stirring tank equipped with heating, 5.97 weight percent of stearylamine and 0.68 weight percent cyclohexyl amine added, and heated to 60° C. with stirring. Then the mixture of amine and base oil was added from the separate stirring tank to the reactor at 60° C. with stirring. After that, the batch was heated to 180° C. with stirring. The temperature of 180° C. was maintained for 30 minutes, and IR spectroscopy was used to check for complete conversion of the isocyanate by observing the NCO band between 2250 and 2300 $cm^{-1}$. The batch was cooled afterward. In another separate stirring tank equipped with heating, 5.53 weight percent calcium lignosulfonate was heated with stirring to 120° C. in one sixth of the planned quantity of base oil, and the water contained therein vaporized for two hours. In the cooling phase at 80° C., the mixture of calcium lignosulfonate and base oil was added from the separate tank to the diurea produced in the reactor at 80° C. Then the additives were added. After adjustment of the batch to the desired consistency by addition of the remaining base oil, the final product was homogenized.

Production Example G

Comparative Example of a Calcium Complex Soap Thickener—Lignin Derivative Co-Heated During Production:

Two thirds of 80.80 weight percent base oil were diluted with 10.4 weight percent calcium complex soap and 6.8 weight percent calcium lignosulfonate in a reactor. The batch was heated to 225° C. with stirring, and the volatile components were vaporized in the process. After a dwell time of 30 minutes, the additives were mixed in at 80° C. in the cooling phase. After adjustment of the batch to the desired consistency by addition of the remaining base oil, the final product was homogenized.

Production Examples

Example H and I

Comparative Examples of Diurea Thickener—Lignin Derivative Stirred in as an Additive at Below 110° C.:

One third of the planned quantity of base oil (for H: 75.3 weight percent, for I: 81.23 weight percent) was placed in a reactor equipped with heating, 4,4'-diphenylmethane diisocyanate (for H: 5.18 weight percent, for I: 3.84 weight percent) added and heated to 60° C. with stirring A further third of the planned quantity of base oil was placed in a separate stirring tank which can be heated, amine added (for H: 7.96 weight percent of n-octylamine and 0.97 weight percent of p-toluidine, for I: 6.34 weight percent of stearylamine and 0.72 weight percent cyclohexyl amine) and heated to 60° C. with stirring. Then the mixture of amine and base oil was added from the separate stirring tank to the reactor at 60° C. with stirring. After that, the batch was heated to 180° C. with stirring and kept at this temperature for 30 minutes. Here IR spectroscopy was used to check for complete conversion of the isocyanate by observing the NCO band between 2250 and 2300 $cm^{-1}$. In the cooling phase, additives and calcium lignosulfonate (for H: 8.59 weight percent, for I: 5.87 weight percent) were added to the batch at below 110° C. After adjustment of the batch to the desired consistency by addition of the remaining base oil, the final product was homogenized.

The tests shown in the tables, which are based on internal methods, are explained below:

Foam Test

A 250 ml measurement cylinder with fine gradations (wide design) is filled with 100 ml of the grease to test and placed in a drying oven at 150° C. for three hours. The grease rises due to residual water (substances volatilizing out) which it contains. The percentage rise of the lubricating grease in the measurement cylinder is red after three hours in steps of 5%.

Universal Shaft Service Life Test

Service life test with 4 complete driveshafts (4 fixed joints and 4 slip joints). These are run in a special program (steering angle, rpm, acceleration and braking cycles). After at most 10 million overrolling motions, the first visual inspection of the joints was performed, earlier if a failure already occurred. If the joints remain capable of operation, the testing program is continued. The time was recorded (in millions of overrolling motions) at which the driveshafts were no longer capable of operating or until a failure occurred. The steady-state temperature continued to be recorded. After the service life test was completed, the lubricating grease used was subjected to a worked penetration measurement according to DIN ISO 2137. The higher the worked penetration measured, the more the lubricating grease softened with the stress in the universal joint.

TABLE 1

| (formulation) | | | | |
|---|---|---|---|---|
| | | Reference number | | |
| | | A | A1 | A2 (comparison) |
| | | Lignin derivative | | |
| | | Ca lignosulfonate | Ca lignosulfonate | Ca lignosulfonate |
| | | Production process | | |
| | | Ca LS co-heated | Ca LS co-heated | Ca LS additive,not heated |
| | | Thickener | | |
| | | Diurea A | Diurea A | Diurea A |
| 1. Lignin derivatives | | | | |
| calcium lignosulfonate | [wt %] | 6.99 | 7.00 | 7.00 |
| sodium lignosulfonate | [wt %] | | | |
| 2. Thickener | | | | |
| 2.1 Amines | | | | |
| p-toluidine | [wt %] | 1.29 | 1.29 | 1.29 |
| cyclohexylamine | [wt %] | | | |

TABLE 1-continued

| (formulation) | | | | |
|---|---|---|---|---|
| n-octylamine | [wt %] | 4.76 | 4.68 | 4.68 |
| stearylamine | [wt %] | | | |
| hexamethylene diamine | [wt %] | | | |
| 2.2 Isocyanate | | | | |
| 4,4'-diphenylmethane diisocyanate | [wt %] | 6.45 | 6.63 | 6.03 |
| 2.3 Alcohol | | | | |
| tetradecanol | [wt %] | | | |
| 2.4 Soap thickener | | | | |
| calcium complex soap | [wt %] | | | |
| 3. Base oils | | | | |
| Mixed basic mineral oil (w/v40 = 100 $mm^2/s$) | [wt %] | 78.51 | 78.4 | 79.0 |
| 4. Additives | | | | |
| antioxidant 1 | [wt %] | 0.5 | 0.5 | 0.5 |
| antioxidant 2 | [wt %] | 0.5 | 0.5 | 0.5 |
| graphite solid lubricant | [wt %] | 1 | 1 | 1 |
| 5. Parameters | | | | |
| thickener content w/o lignin derivative | [wt %] | 12.5 | 12.6 | 12.0 |
| thickener content w/lignin derivative | [wt %] | 19.49 | 19.6 | 19.0 |
| isocyanate excess | [mol %] | 5.49 | 10.0 | — |
| cone penetration as per DIN ISO 2137 | [0.1 mm] | 328 | 312 | 330 |

| | | Reference number | | | |
|---|---|---|---|---|---|
| | | B | C | D | E |
| | | Lignin derivative | | | |
| | | Ca lignosulfonate | Ca lignosulfonate | Ca lignosulfonate | Na lignosulfonate |
| | | Production process | | | |
| | | Ca LS co-heated | Ca LS co-heated | Ca LS co-heated | Na LS co-heated |
| | | Thickener | | | |
| | | Diurea B | Tetraurea | Diurethane/Urea | Diurea B |
| 1. Lignin derivatives | | | | | |
| calcium lignosulfonate | [wt %] | 5.4 | 6.92 | 7.1 | |
| sodium lignosulfonate | [wt %] | | | | 5.7 |
| 2. Thickener | | | | | |
| 2.1 Amines | | | | | |
| p-toluidine | [wt %] | | | | |
| cyclohexylamine | [wt %] | 0.61 | 1.57 | 1.24 | 0.65 |
| n-octylamine | [wt %] | | 2.05 | 1.61 | |
| stearylamine | [wt %] | 4.96 | | | 5.3 |
| hexamethylene diamine | [wt %] | | 2.4 | | |
| 2.2 Isocyanate | | | | | |
| 4,4'-diphenylmethane diisocyanate | [wt %] | 3.22 | 9.41 | 4.77 | 3.45 |
| 2.3 Alcohol | | | | | |
| tetradecanol | [wt %] | | | 2.56 | |
| 2.4 Soap thickener | | | | | |
| calcium complex soap | [wt %] | | | | |
| 3. Base oils | | | | | |
| Mixed basic mineral oil (w/v40 = 100 $mm^2/s$) | [wt %] | 83.81 | 75.65 | 80.72 | 82.9 |
| 4. Additives | | | | | |
| antioxidant 1 | [wt %] | 0.5 | 0.5 | 0.5 | 0.5 |
| antioxidant 2 | [wt %] | 0.5 | 0.5 | 0.5 | 0.5 |
| graphite solid lubricant | [wt %] | 1 | 1 | 1 | 1 |
| 5. Parameters | | | | | |
| thickener content w/o lignin derivative | [wt %] | 8.79 | 15.43 | 10.18 | 9.4 |
| thickener content w/lignin derivative | [wt %] | 14.19 | 22.35 | 17.28 | 15.1 |

TABLE 1-continued (formulation)

| | | | | | |
|---|---|---|---|---|---|
| isocyanate excess | [mol %] | 4.80 | 3.02 | 3.30 | 5.15 |
| cone penetration as per DIN ISO 2137 | [0.1 mm] | 324 | 323 | 322 | 328 |
| | | Reference number | | | |
| | | F | G (comparison) | H (comparison) | I (comparison) |
| | | Lignin derivative | | | |
| | | Ca lignosulfonate | Ca lignosulfonate | Ca lignosulfonate | Ca lignosulfonate |
| | | Production process | | | |
| | | Lignin heated in oil, as additive, not heated | Ca LS co-heated | Lignin as additive, not heated | Lignin as additive, not heated |
| | | Thickener | | | |
| | | Diurea B | Calcium complex | Diurea A | Diurea B |
| 1. Lignin derivatives | | | | | |
| calcium lignosulfonate | [wt %] | 5.53 | 6.8 | 8.59 | 5.87 |
| sodium lignosulfonate | [wt %] | | | | |
| 2. Thickener | | | | | |
| 2.1 Amines | | | | | |
| p-toluidine | [wt %] | | | 0.97 | |
| cyclohexylamine | [wt %] | 0.68 | | | 0.72 |
| n-octylamine | [wt %] | | | 7.96 | |
| stearylamine | [wt %] | 5.97 | | | 6.34 |
| hexamethylene diamine | [wt %] | | | | |
| 2.2 Isocyanate | | | | | |
| 4,4'-diphenylmethane diisocyanate | [wt %] | 3.64 | | 5.18 | 3.84 |
| 2.3 Alcohol | | | | | |
| tetradecanol | [wt %] | | | | |
| 2.4 Soap thickener | | | | | |
| calcium complex soap | [wt %] | | 10.4 | | |
| 3. Base oils | | | | | |
| Mixed basic mineral oil (w/ v40 = 100 $mm^2/s$) | [wt %] | 82.18 | 80.8 | 75.3 | 81.23 |
| 4. Additives | | | | | |
| antioxidant 1 | [wt %] | 0.5 | 0.5 | 0.5 | 0.5 |
| antioxidant 2 | [wt %] | 0.5 | 0.5 | 0.5 | 0.5 |
| graphite solid lubricant | [wt %] | 1 | 1 | 1 | 1 |
| 5. Parameters | | | | | |
| thickener content w/o lignin derivative | [wt %] | 10.29 | 10.4 | 14.11 | 10.9 |
| thickener content w/lignin derivative | [wt %] | 15.82 | 17.2 | 22.7 | 16.77 |
| isocyanate excess | [mol %] | | | | |
| cone penetration as per DIN ISO 2137 | [0.1 mm] | 308 | 340 | 329 | 318 |

TABLE 2

(thermal stability and water content)

| | | Reference number | | | | |
|---|---|---|---|---|---|---|
| | | A | B | C | D | E |
| Lignin derivative | | Ca lignosulfonate | Ca lignosulfonate | Ca lignosulfonate | Ca lignosulfonate | Na lignosulfonate |
| Production process | | Ca LS co-heated | Ca LS co-heated | Ca LS co-heated | Ca LS co-heated | Na LS co-heated |
| Thickener | | Diurea A | Diurea B | Tetraurea | Diurethane/Urea | Diurea B |
| Residual moisture | | | | | | |
| water content (KFT) | DIN 51777-1 [mg/kg] | 150 | 85 | 30 | 536 | 95 |
| ppm $H_2O$/g lignin | | 21 | 16 | 4 | 75 | 17 |
| foam test at 150° C./3 h | see explanation [vol %] | 20 | 15 | 20 | 40 | 10 |

TABLE 2-continued (thermal stability and water content)

| | | | | | | |
|---|---|---|---|---|---|---|
| Thermal stability | | | | | | |
| evaporation loss 48 h/150° C. | DIN 58397-1 [wt %] | 7.9 | 6.33 | 6.53 | 7.12 | 6.47 |

| | | Reference number | | | |
|---|---|---|---|---|---|
| | | F | G | H | I |
| Lignin derivative | | Ca lignosulfonate | Ca lignosulfonate | Ca lignosulfonate | Ca lignosulfonate |
| Production process | | Lignin heated in oil, additive, not heated | Ca LS co-heated | Lignin as additive, not heated | Lignin as additive, not heated |
| Thickener | | Diurea B | Calcium complex | Diurea A | Diurea B |
| Residual moisture | | | | | |
| water content (KFT) | DIN 51777-1 [mg/kg] | 203 | 318 | 1473 | 4859 |
| ppm $H_2O$/g lignin | | 37 | 52 | 171 | 828 |
| foam test at 150° C./3 h | see explanation [vol %] | 25 | 15 | 40 | 40 |
| Thermal stability | | | | | |
| evaporation loss 48 h/150° C. | DIN 58397-1 [wt %] | 11.45 | 4.84 | 12.73 | 14.07 |

TABLE 3

(rheological data)

| | | Reference number | | | | |
|---|---|---|---|---|---|---|
| | | A | B | C | D | E |
| Lignin derivative | | Ca lignosulfonate | Ca lignosulfonate | Ca lignosulfonate | Ca lignosulfonate | Na lignosulfonate |
| Residual moisture | | | | | | |
| water content (KFT) | DIN 51777-1 [mg/kg] | 150 | 85 | 30 | 536 | 95 |
| ppm $H_2O$/g lignin | | 21 | 16 | 4 | 75 | 17 |
| foam test at 150° C./3 h | see explanation [vol %] | 20 | 15 | 20 | 40 | 10 |
| Thermal stability | | | | | | |
| evaporation loss 48 h/150° C. | DIN 58397-1 [wt %] | 7.9 | 6.33 | 6.53 | 7.12 | 6.47 |

| | | Reference number | | | |
|---|---|---|---|---|---|
| | | F | G | H | I |
| Lignin derivative | | Ca lignosulfonate | Ca lignosulfonate | Ca lignosulfonate | Ca lignosulfonate |
| Residual moisture | | | | | |
| water content (KFT) | DIN 51777-1 [mg/kg] | 203 | 318 | 1473 | 4859 |
| ppm $H_2O$/g lignin | | 37 | 52 | 171 | 828 |
| foam test at 150° C./3 h | see explanation [vol %] | 25 | 15 | 40 | 40 |
| Thermal stability | | | | | |
| evaporation loss 48 h/150° C. | DIN 58397-1 [wt %] | 11.45 | 4.84 | 12.73 | 14.07 |

TABLE 4

(universal shaft drive)

| | | Invention example | Reference example |
|---|---|---|---|
| | Reference number | A | G |
| | Lignin derivative | Ca lignosulfonate | Ca lignosulfonate |
| | Production process | Ca LS co-heated | Ca LS co-heated |
| | Thickener | Diurea A | Ca complex soap |
| Pw before USD | DIN ISO 2137 | 328 | 340 |
| Number of overrolling motions | | 28 million | 20 million |
| Consistency after USD | | — | |

TABLE 4-continued (universal shaft drive)

| | Reference number | Invention example A | Reference example G |
|---|---|---|---|
| | Lignin derivative | Ca lignosulfonate | Ca lignosulfonate |
| | Production process | Ca LS co-heated | Ca LS co-heated |
| | Thickener | Diurea A | Ca complex soap |
| Pu | DIN ISO 2137 [0.1 mm] | 380 | 275 |
| Pw | DIN ISO 2137 [0.1 mm] | 388 | 294 |

TABLE 5

(thickener content/consistency, oil separation, wear and tear)

| | Reference number | A1 | A2 (comparison) |
|---|---|---|---|
| | Lignin derivative | Ca lignosulfonate | Ca lignosulfonate |
| | Production process | Ca LS co-heated | Ca LS additive, not heated |
| | Thickener | Diurea A | Diurea A |
| thickener content w/o lignin derivative | [wt %] | 12.6 | 12.0 |
| thickener content w/lignin derivative | [wt %] | 19.6 | 19.0 |
| isocyanate excess | [mol %] | 10.0 | — |
| Penetrations | | | |
| cone penetration (×60) as per | DIN ISO 2137 [0.1 mm] | 312 | 330 |
| unworked penetration as per DIN ISO 2137 | DIN ISO 2137 [0.1 mm] | 312 | 322 |
| cone penetration (×60000) per DIN ISO 2137 | DIN ISO 2137 [0.1 mm] | 334 | 357 |
| difference of cone penetration (×60000) − (×60) | [0.1 mm] | 22 | 27 |
| Oil separation | | | |
| oil separation after 18 h at 40° C. | DIN51817 [wt %] | 0.9 | 1.9 |
| oil separation after 18 h at 100° C. | DIN51817 [wt %] | 4.9 | 7.7 |
| Vibrational fretting | | | |
| SRV Vibrational fretting increase run Cargo weight (50° C., 50 Hz, 1 mm, Method A) | ASTM D 5706 [N] | >2000 | 1200 |

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of the structures and the combination of the individual elements may be resorted to without departing from the spirit and scope of the invention.

The invention claimed is:

1. A method for preparing a lignin derivative-containing lubricating grease comprising the following steps:

bringing together an amine component having reactive amine groups including optional reactive —OH groups with an isocyanate component in a base oil and reacting the same to become a polyurea thickener;

heating at least the polyurea thickener above 120° C. to produce a base grease comprising at least the polyurea thickener and the base oil; and cooling the base grease;

wherein the method comprises subjecting a lignin derivative to an elevated temperature greater than 110° C. in base oil to obtain a heated lignin derivative and wherein the heated lignin derivative and the polyurea thickener and/or the amine component and the isocyanate component are brought in contact with each other and are subjected to a temperature greater than 120° C. in the base oil, for at least 30 minutes, and wherein the isocyanate component is used with a stoichiometric excess of isocyanate groups with respect to the reactive amine groups and the optional reactive —OH groups of the amine component so that a portion of the isocyanate groups of the isocyanate component reacts with the lignin derivative, wherein the lignin derivative is a lignosulfonate or a kraft lignin or an organosolv lignin or their mixtures;

and the lignin derivative-containing lubricating grease comprises:

55 to 92 weight percent base oil;

5 to 20 weight percent polyurea thickener; and 0.5 to 15 weight percent lignin derivative, and optionally:

0 to 40 weight percent additives;

0 to 20 weight percent soap thickener or complex soap thickener based on calcium, lithium or aluminum salts;

0 to 20 weight percent inorganic thickener;

0 to 10 weight percent solid lubricant.

2. The method according to claim 1, in which the lignin derivative in the base oil is subjected to an elevated temperature of greater than 120° C.

3. The method according to claim 1 wherein the heating to produce a base grease containing at least the polyurea thickener comprises heating to a temperature greater than 170° C.

4. The method according to claim 1, wherein the lignin derivative is added to the amine and the isocyanate component after the amine and the isocyanate component were brought together and during the reaction of the amine component with the isocyanate component in the base oil.

5. The method according to claim 1, wherein the heated lignin derivative is added after bringing together the amine component with the isocyanate component at a time the conversion of the amine component with the isocyanate component is essentially completed.

6. The method according to claim 1, wherein the amine component comprises monoaminohydrocarbyl, di- and/or polyaminohydrocarbylene compounds and optionally alsomonohydroxycarbyl, di- or polyhydroxyhydrocarbylene or aminohydroxyhydrocarbylene compounds.

7. The method according to claim 1, wherein the isocyanate component comprises polyisocyanates and the polyisocyanates are hydrocarbons with two or more isocyanate groups.

8. The method according to claim 1, wherein the isocyanate excess amounts to 0.1 to 10 mol percent, preferably 5 to 10 mol percent.

9. The method according to claim 1, wherein the base oil has a kinematic viscosity of 20 to 2500 $mm^2/s$ at 40° C.

10. The method according to claim 1, wherein the lignin derivative-containing lubricating grease includes one or more additives selected from one or more of the following groups:

antioxidants such as amine compounds, phenol compounds, sulfur antioxidants, zinc dithiocarbamate or zinc dithiophosphate;

high-pressure additives such as organochlorine compounds, sulfur, phosphorus or calcium borate, zinc dithiophosphate, organobismuth compounds;

C2- to C6-polyols, fatty acids, fatty acid esters or animal or vegetable oils;

anticorrosion agents such as petroleum sulfonate, dinonylnaphthalene sulfonate or sorbitan esters;

metal deactivators such as benzotriazole or sodium nitrite;

viscosity promoters such as polymethacrylate, polyisobutylene, oligo-dec-1-ene and polystyrenes;

wear-protection additives such as molybdenum dialkyl dithiocarbamate or molybdenum sulfide dialkyl dithiocarbamate, aromatic amines;

friction modifiers such as functional polymers like oleylamides, organic compounds based on polyethers and amides or molybdenum dithiocarbamate; and solid lubricants such as polymer powders like polyamides, polyimides or PTFE, graphite, metal oxides, boron nitride, metal sulfides such as molybdenum disulfide, tungsten disulfide or mixed sulfides based on tungsten, molybdenum, bismuth, tin and zinc, inorganic salts of alkali and alkaline earth metals such as calcium carbonate, sodium and calcium phosphates.

11. A lubricating grease, wherein the lubricating grease is obtainable by the method according to claim 1.

12. The lubricating grease according to claim 11, comprising:

70 to 92 weight percent of the base oil;

0 to 40 weight percent additives;

5 to 20 weight percent of the polyurea thickener;

0.5 to 15 weight percent of the lignin derivatives;

and optionally:

0 to 20 weight percent soap thickener or complex soap thickener based on calcium, lithium or aluminum salts;

0 to 20 weight percent inorganic thickener such as bentonite or silica gel; and/or 0 to 10 weight percent solid lubricant.

13. A use of the lubricating grease according to claim 11, comprising lubricating at least one universal joint, a transmission or a rolling contact or sliding bearing.

14. The method according to claim 1, in which the lignin derivative in the base oil is subjected to an elevated temperature of greater than 170° C.

15. The method according to claim 2, wherein the lignin derivative in the base oil is subjected to the elevated temperature for at least 30 minutes.

16. The method according to claim 1 wherein the heating to produce a base grease containing at least the polyurea thickener comprises heating to a temperature greater than 180° C.

17. The method according to claim 3 wherein the heating to produce a base grease containing at least the polyurea thickener comprises heating for at least 30 minutes.

18. The method according to claim 4, wherein the heated lignin derivative is added prior to heating the amine component and the isocyanate component to 120° C.

19. The method according to claim 7, wherein the polyisocyanates have 5 to 20 carbon atoms, optionally containing aromatic groups.

20. The method according to claim 9, wherein the base oil has a kinematic viscosity of 40 to 500 $mm^2/s$ at 40° C.

21. The method according to claim 10, wherein the one or more additives are added to the base grease at temperatures below 100° C. during cooling of the base grease.

22. The lubricating grease according to claim 12, comprising 5 to 20 weight percent additives.

* * * * *